US006363920B1

(12) United States Patent
Parker et al.

(10) Patent No.: US 6,363,920 B1
(45) Date of Patent: Apr. 2, 2002

(54) PROPORTIONAL SOLENOID FOR PURGING FUEL VAPORS

(75) Inventors: Kenneth J. Parker, Lake Orion; John A. Ness, Birmingham; Andrew W. Westergaard, Rochester; Roger L. Kennedy, Jr., Oakland, all of MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/579,416

(22) Filed: May 25, 2000

(51) Int. Cl.[7] ..... F02M 37/04
(52) U.S. Cl. ..... 123/520; 251/129.14
(58) Field of Search ..... 123/520, 519, 123/518, 521, 516, 198 D, 458; 251/129.08, 129.14, 129.16; 137/596.17, 83, 625.65

(56) References Cited

U.S. PATENT DOCUMENTS 2,822,818 A * 2/1958 Breznick
4,196,751 A * 4/1980 Fischer et al. ..... 137/625.65
4,638,830 A * 1/1987 Brown et al. ..... 137/83
5,277,167 A 1/1994 DeLand et al. ..... 123/518
5,549,274 A * 8/1996 Buchanan et al. ..... 251/129.14
5,551,406 A 9/1996 Everingham et al. ..... 123/520
5,606,992 A * 3/1997 Erickson et al. ..... 137/596.17
5,727,532 A 3/1998 Everingham et al. ..... 123/520
5,785,298 A * 7/1998 Kumar ..... 251/129.16
5,970,958 A 10/1999 DeLand et al. ..... 123/520
6,220,569 B1 * 4/2001 Kelly ..... 251/129.08

* cited by examiner

*Primary Examiner*—Carl S. Miller
(74) *Attorney, Agent, or Firm*—Daniel S. Kalka; Roger A. Johnston

(57) ABSTRACT

An improved regulator valve 10 for controlling the purging of fuel vapors collected in a canister 12 and an evaporative emission control system into an intake system 18 of an internal combustion engine employs a solenoid valve assembly 40 with an armature 86 disposed outside of the coil 58 to operate with low friction. A spring 90 separating the armature 86 from the valve member 98 allows the spring 98 to absorb most of the magnetic and gravitational side loading.

18 Claims, 2 Drawing Sheets

PROPORTIONAL SOLENOID FOR PURGING FUEL VAPORS

CROSS-REFERENCE TO RELATED APPLICATIONS

Not Applicable.

STATEMENT REGARDING FEDERALLY SPONSORED RESEARCH OR DEVELOPMENT

Not Applicable.

MICROFICHE APPENDIX

Not Applicable.

BACKGROUND OF THE INVENTION

1. Field of the Invention

The present invention relates in general to electronically-controlled fuel vapor management valves, and in particular to an electronically-controlled proportional solenoid valve for purging fuel vapors.

2. Description of the Related Art

Modern vehicles are equipped with emission control systems designed to limit the emission of hydrocarbons into the atmosphere. These emission control systems typically use an evaporative emission control design to trap fuel vapors from the fuel tank in a canister, which is usually carbon filled, and a purge system designed to draw the vapors from the canister into the engine intake manifold for combustion.

Conventional evaporative emission control systems are equipped with a fixed area purge valve for regulating the flow rate of fuel vapors introduced into the intake system in response to the pressure difference between the intake manifold and atmosphere. These purge valves typically utilize a pulse width modulated (PWM) solenoid valve which is responsive to a duty cycle control signal from an engine controller unit (ECU) which is usually microprocessor based, for selectively establishing and terminating communication between the canister and the intake system. These purge valves often provide uneven flow characteristics, particularly at low engine speeds, and also do not provide consistent flow control independent of variations in manifold vacuum and inlet pressure.

A recent design in U.S. Pat. No. 5,277,167, which is commonly owned by the Assignee of the present invention and hereby incorporated by reference, discloses a vapor management valve that combines an electric vacuum regulator (EVR) valve with a vacuum regulator valve. That device generates an output flow characteristic that is proportional to the duty cycle of the electric control signal independent of variations in the manifold vacuum.

U.S. Pat. Nos. 5,551,406 and 5,727,532 both relate to on-board evaporative emission control systems, and disclose still other designs of the cannister purge valve.

In order to satisfy even more increasing stringent emission regulations from the Environmental Protection Agency (EPA), it is necessary to provide purge flow even at engine idle speeds. The purge flow control must also be accurately regulated across the entire engine operating range so as not to cause unacceptable exhaust emissions. U.S. Pat. No. 5,970,958 discloses a fuel vapor purge control system with a variable area valve and pressure regulator. This device is operable to generate non-linear output flow characteristics independent of changes in the intake manifold vacuum. This patent is also assigned to the Assignee of the present invention and hereby incorporated by reference.

There still exists a need for an improved linear proportional solenoid valve which enables better proportional flow control and has increased durability. It is desirable to have a linear proportional solenoid valve with low friction. The low friction enables better proportional flow control of the fuel vapors with the appropriate driver circuit. Additionally, it is desirable that the linear proportional solenoid valve have increased durability. This allows the linear proportional valve to be mounted horizontally which would make the valve less sensitive to road and/or engine vibrations.

BRIEF SUMMARY OF THE INVENTION

One object of the present invention is directed to overcoming the aforementioned problems by providing an improved proportional solenoid valve for purging fuel vapors constructed to meet tougher emission standards for vehicles, including but not limited to, both passenger cars and light duty trucks.

Another object of the present invention is to provide an improved linear proportional solenoid valve for controlling the purging of fuel vapors collected in a canister of an evaporative emission control system.

Still another object of the present invention is to provide an improved linear proportional solenoid valve for purging fuel vapors that includes a design which enables the valve to have extremely low friction.

Still another object of the present invention is to provide a linear proportional solenoid valve assembly that includes a spider spring feature for absorbing most of the magnetic and gravitational side floating.

Still another object of the present invention is to provide a linear proportional solenoid valve with increased durability to allow the valve to be mounted horizontally making it less sensitive to road and/or engine vibrations.

Still another object of the present invention is to provide a linear proportional solenoid valve for controlling the flow of fluid from a fluid source to a fluid sink.

Still another object of the present invention is to provide a method for purging fuel vapors of an internal combustion engine.

Still another object of the present invention is to provide a linear proportional solenoid valve assembly which is rugged in construction and economical to manufacture.

The linear proportional solenoid valve in accordance with the present invention comprises a housing having a chamber formed therein, an inlet port providing fluid communication from a canister to the chamber, and an outlet port providing fluid communication from the chamber to an intake system of an internal combustion engine, and a solenoid valve assembly which includes an armature, an electromagnetic coil, and a valve member operatively connected to the armature and disposed between the inlet port and the outlet port for controlling fluid flow therethrough in accordance with an electrical control signal supplied to the electromagnetic coil. Advantageously, in accordance with the present invention, the armature is disposed outside of the electromagnetic coil of the solenoid valve assembly and includes means for resiliently biasing the armature away from the electromagnetic coil. The linear proportional solenoid valve in accordance with the preferred embodiment of the present invention employs a spider spring separating the armature from the valve member. The spider spring is constructed to absorb most of the magnetic and gravitational side load from the armature.

The present invention is also directed to a method for purging fuel vapors of an internal combustion engine which comprises the steps of collecting fuel vapors in a canister, providing a housing with a chamber formed therein, an inlet port for fluidly communicating from the canister to the chamber, and an outlet port for fluidly communicating from the chamber to an intake system of the internal combustion engine, disposing an electrically operated valve assembly with a valve member in the housing with a valve member being positioned between the inlet port and the outlet port, the electrically operated valve assembly having an armature and an electromagnetic coil operative to control movement of the armature, disposing the armature in a biased position outside of the electromagnetic coil of the electrically operated valve assembly and opening the valve member periodically with a valve shaft responsive to movement of the armature at periodic intervals for purging fuel vapors from the canister for combustion in the internal combustion engine.

The various features of novelty which characterize the present invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is described and illustrated.

DETAILED DESCRIPTION OF THE INVENTION

Figure 1:
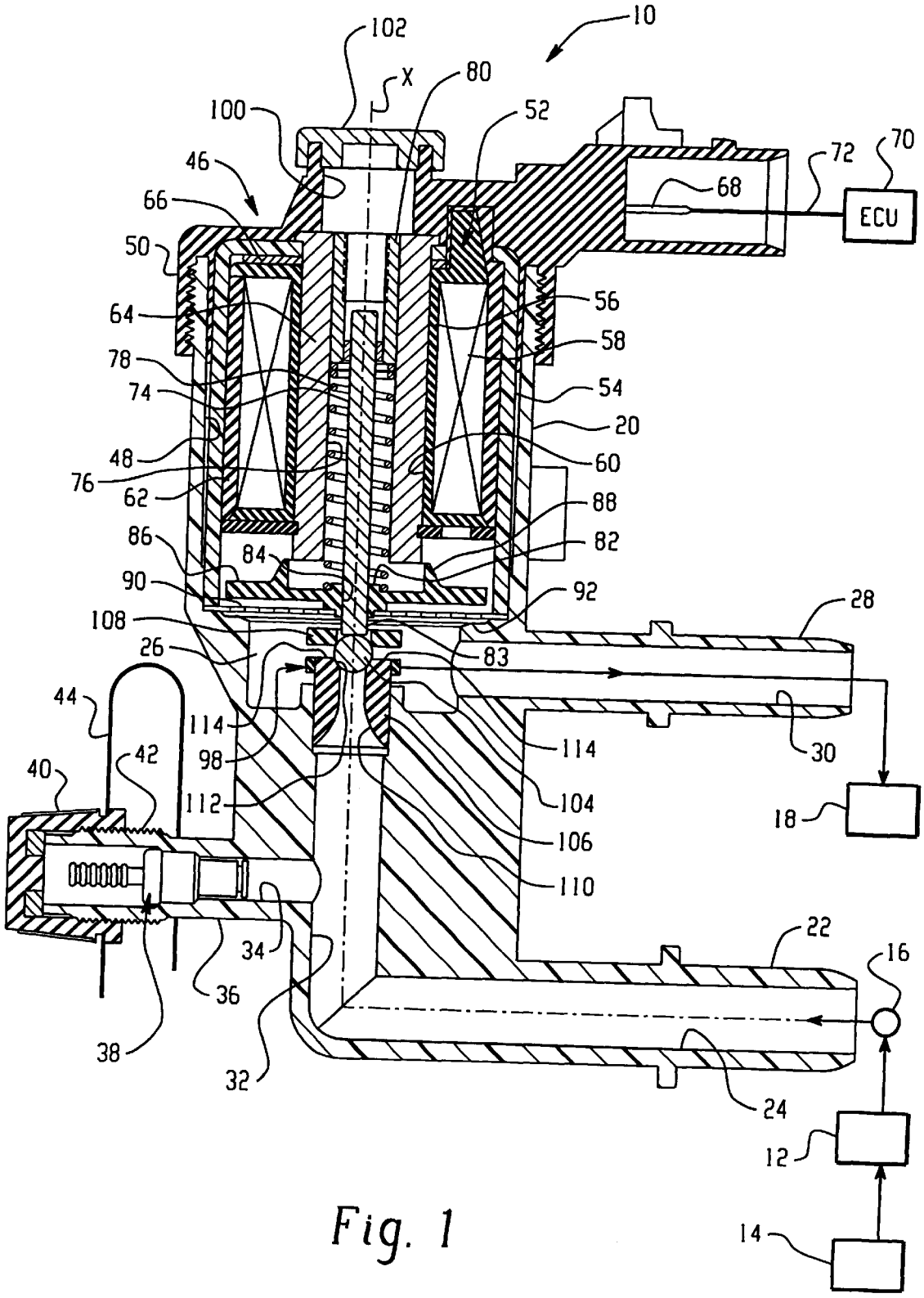
FIG. 1 is a sectional view of the electrically operated valve assembly in accordance with the present invention.

Referring to the drawings, which are not intended to limit the present invention and where like numerals designate like or similar features, and first to FIG. 1, there is shown in sectional view a linear proportional solenoid valve assembly for purging fuel vapors (generally designated 10) in accordance with the present invention. In general, the solenoid valve assembly 10 is an improvement in a linear proportional valve of the type used for controlling the flow of fluid from a fluid source to a fluid sink. More preferably, the present invention is particularly suited for use in an evaporative emission control system for purging fuel vapors collected in a charcoal canister 12 receiving fuel vapors vented from a fuel tank 14 from a vehicle (not shown). An optional filter 16 may be included in a flow path between canister 12 and the variable regulator valve assembly 10 to filter foreign material and any charcoal particles that may be released from canister 12.

As will be described in greater detail, the valve assembly 10 accurately regulates fuel vapor purge flow from canister 12 to an intake manifold 18 of an internal combustion engine for combustion therein. However, it will be readily appreciated that the improved purge regulator valve assembly 10 in accordance with the present invention has utility in other applications, such as, variable force solenoid applications, power steering valves and exhaust gas recirculation valves.

Regulator valve assembly 10 includes a housing or valve body 20 preferably constructed of a plastic material such as "Nylon 12". A nippled inlet connector 22 extending from housing 20 has an inlet passage or port 24 formed therein to provide fluid communication from canister 12 to chamber 26 disposed within the housing 20. In a similar manner, nippled outlet connector 28 extends from the housing body 20 with an outlet passage or port 30 formed therein for providing fluid communication between chamber 26 and intake manifold 18.

A portion 32 of inlet passage 24 is ported to an auxiliary passage 34 which is formed with a test connector 36 that extends from the body 20 preferably in a direction away from or opposite the inlet connector 22 and the outlet connector 28. Test connector 36 preferably includes a pressure measuring valve assembly indicated generally at 38 threadably engaged within auxiliary passage 34. Test port cover 40 threadably engages an outer threaded surface 42 of test port 36 and seals the pressure measuring valve assembly 38 from the outside environment. Test port 36 and pressure measuring valve assembly 38 are employed to test the system for leaks. Pressure measuring valve assembly 38 is constructed similarly to that of a tire inflation valve assembly and is well known to those skilled in this art. Wire 44 retains test port cover 40 securely on the threads 42 of the test port 36. Preferably, the portion 32 of the inlet passage 24 is situated at an angle approximating 90° or substantially normal to inlet passage 24 and outlet passage 30.

Figure 2:
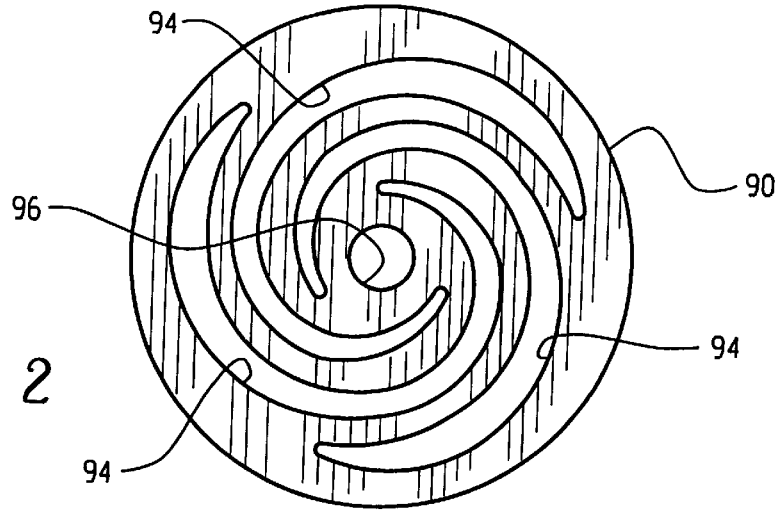
FIG. 2 is a top view of the spider spring according to the present invention.

A solenoid assembly indicated generally at 46 is positioned within the valve body 20 and is substantially axially aligned with passage 32 on a central longitudinal axis x in the preferred embodiment. Solenoid assembly 46 is disposed within a cavity 48 at one end of the valve body 20. While the regulator valve assembly 10 and solenoid valve assembly 46 are shown assembled as a unitary component within housing or valve body 20, it is to be understood that these assemblies could be separate components that are interconnected for communication therebetween. A cover 50 molded or encapsulated engages valve body 20 for enclosing the solenoid assembly 46 within the preferably tubular shaped cavity 48 of valve body 20. Solenoid assembly 46 includes an electromagnetic coil assembly 52 disposed within a solenoid case 54. The electromagnetic coil assembly 52 comprises a spool shaped bobbin 56 formed of a non-magnetic material having a wire coil 58 wound thereon to form the coil assembly 52 with a bore 60 formed therethrough that extends along the central longitudinal axis x. The electromagnetic coil assembly 52 is preferably provided with a coil encapsulation 62 made of a non-conducting plastic material such as "Nylon 66". A cylindrical magnetic pole piece 64 is disposed within bore 60 of the electromagnetic coil assembly 52. A flux collector in the form of a washer 66 is disposed at one end of the electromagnetic coil assembly 52 and separates the electromagnetic coil assembly 52 from the solenoid case 54 which serves as pole frame completing a flux loop around coil 58. Terminal ends of coil 58 are electrically connected to a pair of blade-type terminals 68 (only one shown). The blade-type terminals 68 are constructed as is known in the art to be electrically connected to an engine control unit (ECU) 70 by way of a suitable wiring harness 72. An armature pin or valve shaft 74 is axially disposed within a bore 76 formed within magnetic pole piece 64 that extends on the central longitudinal axis x. A spring 78 disposed within bore 76 coaxially surrounds valve shaft 74. Spring 78 is retained at its upper end by a spring adjuster 80 and at its lower end by a hub 82 around the periphery of an aperture 84 in armature 86. Aperture 84 in armature 86 is constructed to slidably receive and retain the lower end of valve shaft 74 therethrough. Armature 86 has preferably a circular or disk construction and is situated outside of the electromagnetic coil assembly 52. Armature 86 is slidably disposed within solenoid casing 54 for reciprocating movement along the central longitudinal axis x of the solenoid assembly 46. Preferably, armature 86 includes a neck portion 88 which is constructed to translate axially over a lower end of pole piece 64. A retaining spring 90, having a generally flat configuration and also referred to as a spider spring, is positioned on an edge 92 of cavity 48 of the housing 20. Spider spring 90 preferably includes a plurality of radially spiraling apertures 94 as shown in FIG. 2, and includes a fairly centrally located opening 96 therethrough. Opening 96 of spider spring 90 has a diameter that is sized to slidably slip over a reduced diameter portion 83 of hub 82 of armature 86 on an opposite side from the spring 78. The spider spring 90 is firmly held in a fixed position by the edge 92 and solenoid case 54 about its periphery. Valve shaft 74 extends through aperture 84 of hub 82 into the interior of the armature 86, and continues through opening 96 of spider spring 90 into chamber 26. The valve shaft 74 engages the valve member assembly indicated generally at 98 which is described in greater detail hereinafter. An opening 100 in the upper end of cover 50 of the housing 20 provides external access for engaging spring adjuster 80 to place a pre-load on spring 78 for biasing armature 86 in a position that closes valve member assembly 98 with the employment of valve shaft or armature pin 74. A plug 102 is provided as a cover for opening 100 and seals solenoid assembly 46 from the outside environment.

When the engine control unit 70 applies current at a selected time to the electromagnetic coil assembly 52, this energizes the coil 58 and induces a magnetic field that provides a flux path or circuit through the solenoid case 54, the pole piece 64, and across an air gap to armature 86 which effects translational movement of the armature 86 against the force of the biasing spring 78 and spider spring 90. Movement of the armature 86 effects longitudinal translational movement of armature pin 74 simultaneously therewith. The lower end of armature pin 74 releases the valve member assembly 98 to allow fluid flow from passages 24, 32 into chamber 26, and exit through outlet passage 30.

While the geometry of the lower end of armature pin 74 is shown as a valve shaft herein, which is the presently preferred shape, the lower end of armature pin 74 could be adapted to include an alternate geometry, such as a rounded or spherically convexed tip, a flat tip, a tip that tapers to a spherical concaved tip, or a conical tip, which may alternatively eliminate ball 104 of valve member assembly 98.

Figure 3:
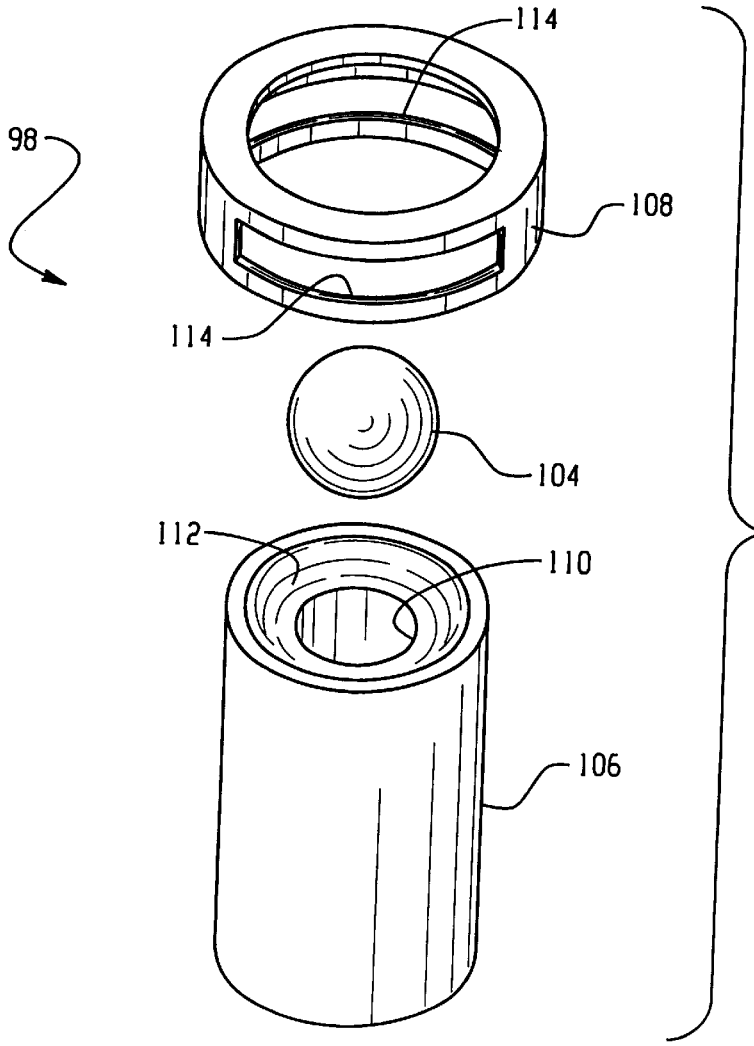
FIG. 3 is an exploded view of the valve member assembly 98.

Referring now to FIG. 3, valve member assembly 98 comprises a ball 104 disposed within a valve seat 106 and valve seat cap 108. Valve seat 106 has preferably a cylindrical form with a Venturi nozzle shaped passage 110 (best seen in FIG. 1) extending therethrough. Valve passage 110 includes an inwardly tapering ball seating surface 112. Valve seat cap 108 preferably also has a generally cylindrical configuration and includes radially extending openings 114 which direct the flow out and substantially eliminates flow past the ball 104. Valve seat cap 108 is positioned on the tapered seat surface 112 end of the valve seat 106 and situated within chamber 26 of housing 20. The ball and seat construction employed in the instant invention is constructed to reduce or even eliminate substantial flow from flowing past the ball. This structure forces the flow to exit between the ball 104 and the seat metering angle 112. This design directs the flow induced forces to push the ball 104 into the armature pin 74 and keeps the ball 104 in contact with pin 74 during flow metering. In this manner, uncontrolled ball movement is reduced to prevent flow fluctuation.

While the preferred valve element assembly 98 comprising the ball and seat design is disclosed, it should be understood that any suitable valve element assembly could be used with the present invention. These alternative designs include, but are not limited to, a rounded or spherically convexed tip on armature pin 74 cooperating with the valve seat, a flat tip, or a conical tip, or even eliminating the valve ball 104. Valve element assembly 98 may comprise any valve assembly known in this art or suited for the purpose described herein.

The construction of the linear proportional solenoid assembly employed in the present invention addresses several problems associated with prior art linear proportional solenoid assembly designs. Contrary to the other designs, the present invention places the armature outside of the coil assembly. The spider spring 96 employed in the present invention enables the valve assembly 10 to have extremely low friction. The low friction enables better proportional flow control of the fuel vapors with the driver circuit from the ECU. By placing the spider spring relatively close to the armature, the spider spring can absorb most of the magnetic and gravitational side loading. This allows for increased durability and allows the valve to be mounted horizontally. Mounting the valve horizontally makes it less sensitive to road and/or engine vibrations.

While specific embodiments of the invention have been shown and described in detail to illustrate the application of the principles of the invention, it will be understood that the invention may be embodied otherwise without departing from such principles.

We claim:

1. In an evaporative emission control system for controlling the purging of fuel vapors collected in a canister 12 into an intake system 18 of an internal combustion engine, the improvement comprising:

a housing 20 having a chamber 26 formed therein, an inlet port 24 providing fluid communication from said canister 12 to said chamber 26, and an outlet port 30 providing fluid communication from said chamber 26 to the intake system 18 of an internal combustion engine; and a solenoid valve assembly 46 comprising an armature 86, an electromagnetic coil 58, a pole piece 64 disposed within a bore 60 of said electromagnetic coil 58, a valve shaft 74 axially disposed and resiliently biased within a bore 76 formed within said pole piece 64, and a valve member 98 operatively connected to said valve shaft 74 and disposed between said inlet port 24 and said outlet port 30 for controlling fluid flow therethrough in accordance with an electrical control signal 70 supplied to said electromagnetic coil 58, said armature 86 being disposed outside of said electromagnetic coil 58, said solenoid valve assembly 46 including means for resiliently biasing and retaining 90 said armature 86 away from said electromagnetic coil 58, said armature 86 and said biasing and retaining means 90 being constructed to slidably receive and retain a lower end of said valve shaft 74 extending therethrough for operatively connecting said valve shaft 74 with said valve member 98.

2. A valve 10 as recited in claim 1, wherein said biasing and retaining means comprises a spider spring 90 separating said armature 86 from said valve member 98.

3. The improvement as recited in claim 2, wherein said armature 86 comprises a substantially circular disk 86 having an opening 84 fairly centrally located therethrough, said disk having a neck portion 88 constructed to be axially received over said pole piece 64 centrally located within said solenoid valve assembly 46.

4. The improvement as recited in claim 3, wherein said armature 86 further comprises a centrally positioned hub 82 around a periphery of the opening 84 therein.

5. The improvement as recited in claim 1, wherein said valve member 98 comprises a ball 104 and a valve seat 106.

6. The improvement as recited in claim 5, wherein said ball 104 and said valve seat 106 includes a seat cap 108 constructed to direct the ball 104 up against said valve shaft 74 within said solenoid valve assembly 46 for preventing uncontrolled flow fluctuations.

7. The improvement as recited in claim 4, wherein said spider spring 90 comprises a disk 90 with a substantially centrally disposed aperture 96, said disk further having a plurality of spiraling passages 94 therethrough.

8. A valve 10 for controlling the flow of fluid from a fluid source 14 to a fluid sink 18, comprising:

a housing 20 having a chamber 26 formed therein, said housing 20 having an inlet port 24 for providing fluid communication from said fluid source 14 to said chamber 26, said housing 20 further having an outlet port 30 for providing fluid communication from said chamber 26 to said fluid sink 18; and an electrically operated valve assembly 46 having a valve member 98 disposed between the inlet port 24 and the outlet port 30 for controlling fluid flow from the inlet port 24 to the outlet port 30, said electrically operated valve assembly 46 further having an armature 86, an electromagnetic coil 58, a pole piece 64 disposed within a bore 60 of said electromagnetic coil 58, and a valve shaft 74 axially disposed and resiliently biased within a bore formed within said pole piece 64, said armature 86 being resiliently biased with biasing and retaining means 90 in a location away from said electromagnetic coil 58, said armature 86 and said biasing and retaining means 90 being constructed to slidably receive and retain a lower end of said valve shaft 74 extending therethrough, said valve member 98 being operatively connected to said valve shaft 74 movable with said armature 86.

9. A valve 10 as recited in claim 8, wherein said biasing and retaining means 90 comprises a spring 90 located between said armature 86 and said valve member 98, said spring being a disk with a plurality of cut-outs 94 therein.

10. A valve 10 as recited in claim 9, wherein said armature 86 comprises a substantially circular disk 86 having an opening 84 fairly centrally located therethrough, said disk 86 having a neck portion 88 extending towards a pole piece 64 within said valve assembly 98, said neck portion 88 being constructed to receive an end portion of said pole piece 64.

11. A valve 10 as recited in claim 10, wherein said opening 84 further comprises a hub 82 surrounding said opening 84, said hub having a reduced diameter portion 83 being constructed to receive and engage said spring 90.

12. A valve 10 as recited in claim 11, wherein said plurality of cut-outs 94 within said spring 90 comprise spiraling apertures 94.

13. A valve 10 as recited in claim 10, wherein said valve member 98 comprises a ball 104 and seat 106 valve having a ball valve 104, valve member nozzle 110, and a valve member seat cap 108.

14. A method for purging fuel vapors of an internal combustion engine comprising the steps of:

collecting fuel vapors in a canister 12;

providing a housing 20 with a chamber 26 formed therein, an inlet port 24 for fluidly communicating from said canister 12 to said chamber 26, and an outlet port 30 for fluidly communicating from said chamber 26 to an intake system 18 of the internal combustion engine;

disposing an electrically operated valve assembly 46 with a valve member 98 in said housing 20 and positioning said valve member 98 between said inlet port 24 and said outlet port 30, and energizing a coil and moving an armature 86 electromagnetically to control movement of said valve member;

disposing said armature 86 in a biased position outside of said coil 58;

positioning a pole piece 64 within a bore 60 of said coil 58;

disposing and resiliently biasing a valve shaft 74 within a bore 76 formed within said pole piece 64;

positioning a lower end of said valve shaft 74 through an aperture 84 in said armature 86;

retaining said valve shaft 74 in said armature 86 for operatively connecting said lower end of said valve shaft 74 to said valve member 98; and opening said valve member 98 periodically with said lower end of said valve shaft 74 responsive to movement of said armature 86 for purging fuel vapors from said canister 12 for combustion in the internal combustion engine.

15. A method according to claim 14, wherein the step of disposing said armature 86 in a biased position further comprises the step of separating said armature 86 from said valve member 98 with a spring 90.

16. A method according to claim 15, wherein said spring 90 comprises a spider spring 90.

17. A method according to claim 16, wherein said valve member 98 comprises a ball 104 and seat 106 valve member.

18. A method according to claim 17, further comprising the step of directing said ball 104 of said valve member 98 in contact with said valve shaft 74 for preventing uncontrolled ball movement.

* * * * *